United States Patent [19]

Kraemer et al.

[11] Patent Number: 4,808,066

[45] Date of Patent: Feb. 28, 1989

[54] DEVICE FOR CONVEYING FUEL FROM A SUPPLY TANK TO INTERNAL COMBUSTION ENGINE

[75] Inventors: Hartmuth Kraemer, Ditzingen; Ernst Zolda, Korntal, both of Fed. Rep. of Germany

[73] Assignee: Robert Bosch GmbH, Stuttgart, Fed. Rep. of Germany

[21] Appl. No.: 109,930

[22] Filed: Oct. 19, 1987

[30] Foreign Application Priority Data

Jan. 20, 1987 [DE] Fed. Rep. of Germany ..... 3701382

[51] Int. Cl.[4] ..... F04D 5/00

[52] U.S. Cl. ..... 415/53 T; 415/168

[58] Field of Search ..... 415/53 T, 168, 121 A, 415/121 G, DIG. 7

[56] References Cited

U.S. PATENT DOCUMENTS

| | | | |
|---|---|---|---|
| 2,463,251 | 3/1949 | Curtis | 415/168 |
| 2,780,999 | 2/1957 | Compton et al. | 415/168 |
| 2,807,934 | 10/1957 | Purvis et al. | 415/127 |
| 2,963,979 | 12/1960 | Eisenmann et al. | 415/121 G |
| 2,963,980 | 12/1960 | White | 415/121 G |
| 4,331,537 | 5/1982 | Klauck | 415/121 G |
| 4,461,614 | 7/1984 | Niedermeyer | 415/121 G |
| 4,538,958 | 9/1985 | Takei et al. | 415/168 |

FOREIGN PATENT DOCUMENTS

| | | | |
|---|---|---|---|
| 1019177 | 11/1955 | Fed. Rep. of Germany | 415/121 G |

*Primary Examiner*—Robert E. Garrett
*Assistant Examiner*—John T. Kwon
*Attorney, Agent, or Firm*—Michael J. Striker

[57] ABSTRACT

In a device for supplying fuel from a supply tank to an internal combustion engine of a motor vehicle, which comprises a fuel supply aggregate having a suction opening and at least one pump stage, a degassing passage which connects a pump chamber of the pump stage to the supply tank opens into an upwardly extending and upwardly open channel which is formed between a cup-shaped element and a housing portion of the aggregate so as to separate steam bubbles from fuel.

4 Claims, 1 Drawing Sheet

DEVICE FOR CONVEYING FUEL FROM A SUPPLY TANK TO INTERNAL COMBUSTION ENGINE

BACKGROUND OF THE INVENTION

The present invention relates to a device for conveying or pumping fuel from a supply tank to an internal combustion engine of a motor vehicle.

Fuel pumps of the type under consideration have been known. One of such fuel pumps has been disclosed in U.S. Pat. No. 3,881,839. In this conventional pump the direction of the fuel flow in the fuel supply aggregate is approximately horizontal. Since the degassing passage of the aggregate extends approximately parallel to the fuel flow direction and opens near the suction opening of the fuel supply aggregate steam bubbles can occur in the suction area of the fuel supply aggregate and thus flow again directly into the pumping stage of the device. The screen-type filter which surrounds the suction opening cannot prevent this because suction at the pump stage pulls the steam bubbles through the filter.

SUMMARY OF THE INVENTION

It is an object of the present invention to provide an improved fuel supply device for an internal combustion engine of a motor vehicle.

It is another object of this invention to provide a fuel supply device which would ensure that gas bubbles be separated from fuel and flow from the suction region of the pump stage inside the channel because, as the pumping action takes place, the bubbles are quickly driven upwardly. When bubbles are discharged from the channel they are outside the pump suction area.

These and other objects of the invention are attained by a device for conveying fuel from a supply tank to an internal combustion engine of a motor vehicle, comprising a fuel supply aggregate having a suction opening and including at least one pump stage, a pressure passage leading to the internal combustion engine, said aggregate conveying fuel via the suction opening which opens into the supply tank into said pressure passage, and a degassing passage which connects a pump chamber of said pump stage to the supply tank, said aggregate being arranged so that a fuel flow therein is directed upwardly, said aggregate having an upwardly extending channel into which said degassing passage opens, said channel being open at an upper end thereof and being limited by a structural element provided on said aggregate.

The aggregate may have a housing portion which forms an internal wall for said channel.

Said structural element may be a cup-shaped element, said aggregate vertically standing in said cup-shaped element, said element having a bottom wall having a perforation which correspond to said suction opening, said element having a peripheral wall which forms an external wall for said channel.

According to a further feature of the invention, said peripheral wall has an inner surface which faces said internal wall and is spaced therefrom, said peripheral wall being formed at said inner surface with a plurality of ribs circumferentially spaced from each other and extending towards said internal wall, said ribs centering said aggregate in said cup-shaped element.

The degassing passage may open into said channel near said bottom wall, said channel being limited by two adjacent ribs, said bottom wall and said internal wall.

Furthermore, the bottom wall has an external side which may be flush with said housing portion and is inclined towards an edge of said cup-shaped element, said aggregate having an electric motor having an axis of rotation, said external side including with said axis an acute angle.

The device may further include a sealing element which surrounds said perforation, said aggregate being supported on said bottom wall via said sealing element.

The degassing passage may open into said channel at said internal wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
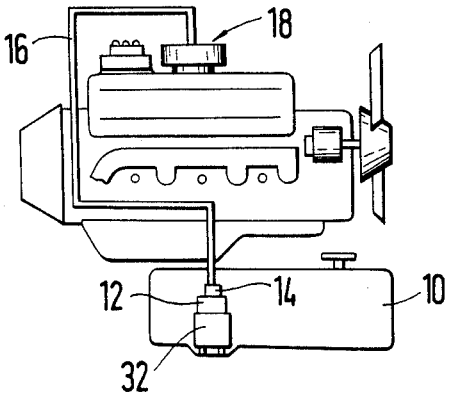
FIG. 1 is a schematic view of the fuel supply device of the invention.

Referring now to the drawings in detail, and firstly to FIG. 1 thereof, it will be seen that reference numeral 10 identifies a fuel supply tank in which a fuel supply aggregate 12 is positioned. A pressure conduit 16 is connected to a pressure connection 14 of the fuel supply aggregate 12. Conduit 16 leads to an internal combustion engine 18. In operation of the internal combustion engine the fuel supply aggregate 12 transfers fuel from supply tank 10 to the internal combustion engine 18.

The fuel supply aggregate 12 has a tubular housing portion 20 the axis of which is vertical when the aggregate 12 is in operation. The fuel supply aggregate 12 includes, in addition to the fuel pump, an electric drive motor 22 which is operatively connected with the fuel pump. The fuel supply pump includes a first pump stage 24 formed as a flow pump which is connected via an intermediate passage 26 with a second pump stage 28 formed as a positive displacement pump. The second pump stage 28 presses a medium being supplied through a non-shown outlet into a space or chamber 30 in which electric drive motor 22 is located, whereby the medium flows through the structural components of the motor towards the pressure connection 14 and from there into the pressure conduit 16.

The fuel supply aggregate 12 is situated in a cup-shaped element 32 made of plastic. A suction opening 36 for the fuel supply pump 24, 28 is provided in a base plate 34, which suction opening opens with such vertical position of the fuel supply aggregate 12 in the downward direction.

Figure 2:
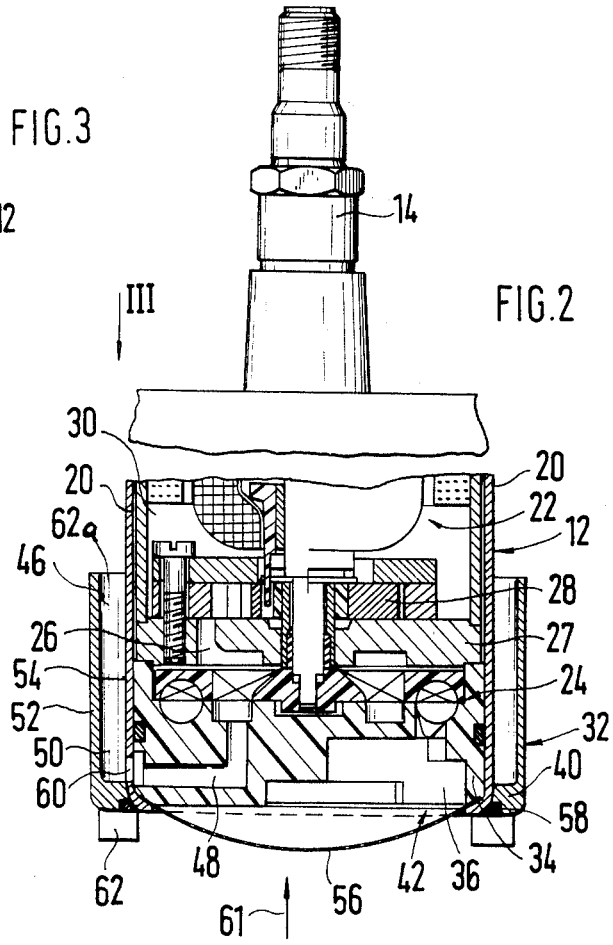
FIG. 2 is an axial sectional view of the fuel supply aggregate in the region of the fuel pump, which belongs to the device of FIG. 1.

As can be seen from FIGS. 1 and 2 the fuel supply aggregate 12 is arranged so that the cup-shaped element 32 thereof is positioned in the pump region. Thereby the inner diameter of the cup-shaped element is greater than the outer diameter of the housing portion 20 of the aggregate 12. Element 32 in the region of its bottom wall 40 has a perforation 42 so that the fuel has easy entrance to the suction opening 36. Radially extending webs or ribs 44 clearly shown in FIG. 3, which are formed on the inner surface 46 of the element 32 and are circumferentially spaced from each other align the fuel supply aggregate 12 in the cup-shaped element 32. The bottom wall 40 snugly closes with its outer side the housing portion 20 so that no edge on which bubbles can collect is obtained. A certain obliquity of the outer side of the bottom wall towards the cup edge or border—also a slope or inclination of the bottom towards the cup edge—serves the purpose of reliable drain of such bubbles. The inclination is also such that the external side of the bottom wall 40 includes with the axis of rotation of electric motor 22 an acute angle.

Figure 3:
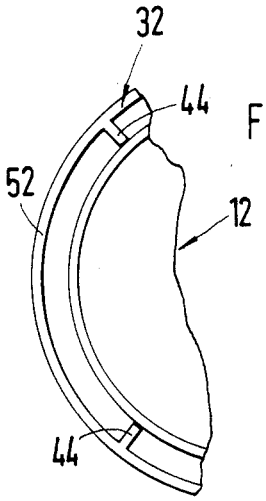
FIG. 3 is a partial view seen from arrow III of FIG. 2.

It has been known that vapor bubbles occur in the region of suction opening 36 of the pump, which bubbles flow via suction opening 36 into the fuel supply aggregate and cause disturbances therein. In order to prevent such disturbances a degassing passage 48 is provided in the base plate 34 of the supply pump 24, 28, which passage opens into a vertical channel 50. The latter is limited by the inner surface 46 of the wall 52 of the cup-shaped element 32, the outer surface 54 of the housing portion 20 of the aggregate 12, bottom wall 40 and two adjacent ribs 44 (FIG. 3). As shown in FIG. 2 channel 50 is open upwardly. The fuel supply aggregate 12 further includes a mesh or filter 56 which collects contaminated particles found in fuel sucked by opening 36. A sealing element 58 formed as an O-ring is arranged between the bottom wall 40 and the fuel supply aggregate 12. Sealing element 58 surrounds perforation 42 of the bottom wall and serves for a clean sealing between opening 60 of the degassing passage 48 and the suction opening 36.

Pumps 24, 28 during the operation of the fuel supply aggregate 12 suck the fuel in the direction of arrow 61. This is possible because supporting feet 62 are provided on the external side of the bottom wall 40 of the element 32. Feet 62 are spaced from each other and fuel has a free access to the suction opening 36. The fuel flows via the suction opening 36 into the first pump stage 24 from where it enters the pressure stage 28 via the intermediate passage 26 in the intermediate plate 27. While the fuel flows through the preliminary or first pump stage 24 the steam bubbles sucked with the fuel are separated there from the fuel and are discharged through the degassing passage 48 from the pump 24, 28. The degassing passage 48 terminates near the bottom wall 40 of the cup-shaped element 32 with an opening 60. Bubbles flow from the opening 60 of the degassing passage 48 into the suction channel 50 in which, as operation continues, the bubbles are driven upwardly and at the opening **62*a* are discharged into the tank. When this takes place steam bubbles are already outside the suction region 36, 42 of the fuel supply aggregate 12** so that a repeated suction of steam bubbles is reliably avoided.

It will be understood that each of the elements described above, or two or more together, may also find a useful application in other types of devices for conveying fuel from a supply tank of an internal combustion engine differing from the types described above.

While the invention has been illustrated and described as embodied in a device for pumping fuel from a supply tank of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A device for conveying fuel from a supply tank to an internal combustion engine of a motor vehicle, comprising a fuel supply aggregate including a housing portion having a suction opening and at least one pump stage, a pressure passage leading to the internal combustion engine, said aggregate conveying fuel via the suction opening, which opens into the supply tank, into said pressure passage, and a degassing passage which connects a pump chamber of said pump stage to the supply tank, said aggregate being provided with a structural element and arranged so that a fuel flow therein is directed upwardly, said aggregate having an upwardly extending channel into which said degassing passage opens, said channel being open at an upper end thereof and being connected to the supply tank to discharge gas bubbles from said degassing passage to the supply tank, said housing portion forming an internal wall for said channel, said structural element being a cup-shaped element, said aggregate vertically standing in said cup-shaped element, said cup-shaped element having a bottom wall having a perforation which corresponds to said suction opening, said cup-shaped element having a peripheral wall which forms an external wall for said channel to limit the latter, said peripheral wall having an inner surface which faces said internal wall and is spaced therefrom, said peripheral wall being formed at said inner surface with a plurality of ribs circumferentially spaced from each other and extending towards said internal wall, said ribs centering said aggregate in said cup-shaped element, said peripheral wall having an inner surface which faces said internal wall and is spaced therefrom, said peripheral wall being formed at said inner surface with a plurality of ribs circumferentially spaced from each other and extending towards said internal wall, said ribs centering said aggregate in said cup-shaped element, said degassing passage opening into said channel near said bottom wall, said channel being limited by two adjacent ribs, said bottom wall and said internal wall.

2. The device as defined in claim 1, said bottom wall having an external side which is flush with said housing portion and is inclined towards an edge of said cup-shaped element, said aggregate having an electric motor having an axis of rotation, said external side including with said axis an acute angle.

3. The device as defined in claim 1; further including a sealing element which surrounds said perforation, said aggregate being supported on said bottom wall via said sealing element.

4. The device as defined in claim 1, wherein said degassing passage opens into said channel at said internal wall.

* * * * *